US007869182B1

(12) United States Patent
Tan et al.

(10) Patent No.: US 7,869,182 B1
(45) **Date of Patent: *Jan. 11, 2011**

(54) MONITORING DEVICE FOR USE WITH AN INSULATED DUAL PORTION GARMENT

(75) Inventors: Huynh P. Tan, San Jose, CA (US); Julius A. Turangan, Livermore, CA (US); Muralidhar R. Dugyala, Milpitas, CA (US)

(73) Assignee: Western Digital Technologies, Inc., Lake Forest, CA (US)

( * ) Notice: Subject to any disclaimer, the term of this patent is extended or adjusted under 35 U.S.C. 154(b) by 438 days.

This patent is subject to a terminal disclaimer.

(21) Appl. No.: 11/637,527

(22) Filed: Dec. 12, 2006

Related U.S. Application Data

(63) Continuation-in-part of application No. 11/508,766, filed on Aug. 23, 2006.

(51) Int. Cl.
*H01H 47/00* (2006.01)

(52) U.S. Cl. ..... 361/220; 361/223

(58) Field of Classification Search ..... 361/223, 361/220

See application file for complete search history.

(56) References Cited

U.S. PATENT DOCUMENTS

| | | | | |
|---|---|---|---|---|
| 2,784,376 | A | 3/1957 | Steele | |
| 3,596,134 | A * | 7/1971 | Burke | 361/220 |
| 4,590,623 | A | 5/1986 | Kitchman | |
| 4,596,053 | A * | 6/1986 | Cohen et al. | 361/220 |
| 4,639,825 | A * | 1/1987 | Breidegam | 361/212 |
| 4,736,157 | A * | 4/1988 | Betker et al. | 324/557 |
| 4,745,519 | A * | 5/1988 | Breidegam | 361/220 |
| 4,800,374 | A * | 1/1989 | Jacobson | 340/649 |
| 5,083,092 | A | 1/1992 | Clark et al. | |
| 5,422,630 | A | 6/1995 | Quinn et al. | |
| 5,426,870 | A | 6/1995 | Purnell et al. | |
| 5,440,444 | A * | 8/1995 | Adams | 361/220 |
| 5,519,384 | A | 5/1996 | Chanudet et al. | |
| 5,548,469 | A * | 8/1996 | Adams | 361/220 |
| 5,576,924 | A | 11/1996 | Hee | |
| 5,666,106 | A | 9/1997 | Nasman | |
| 5,686,897 | A | 11/1997 | Loh | |

(Continued)

OTHER PUBLICATIONS

Desco Industries, Inc., "Dual-Wire Workstation Continuous Monitor Installation, Operation, and Maintenance", Sep. 2006, Desco Technical Bulletin TB-3019, www.desco.com/pdf/tb-3019.pdf, 4 pages.

(Continued)

*Primary Examiner*—Jared J Fureman
*Assistant Examiner*—Christopher J Clark

(57) ABSTRACT

A method is disclosed for monitoring a user wearing a static electricity garment. The garment comprises a first conductive upper body portion including a first electrical interface, a second conductive upper body portion including a second electrical interface, a first user interface for electrically coupling the first conductive upper body portion to a first upper limb of the user, a second user interface for electrically coupling the second conductive upper body portion to a second upper limb of the user, and an insulative portion for electrically insulating the first conductive upper body portion from the second conductive upper body portion. To monitor the static electricity, the user touches the first electrical interface to a first lead of a monitoring device and touches the second electrical interface to a second lead of the monitoring device.

15 Claims, 9 Drawing Sheets

U.S. PATENT DOCUMENTS

| | | | | |
|---|---|---|---|---|
| 5,715,536 | A | 2/1998 | Banks | |
| 5,952,931 | A * | 9/1999 | Chotichanon et al. | 340/649 |
| 5,991,145 | A | 11/1999 | Lagrotta et al. | |
| 5,991,922 | A | 11/1999 | Banks | |
| 6,014,773 | A * | 1/2000 | Banks | 2/69 |
| 6,026,512 | A * | 2/2000 | Banks | 2/69 |
| 6,035,260 | A | 3/2000 | Pohribnij et al. | |
| 6,078,875 | A | 6/2000 | Jubin et al. | |
| 6,140,929 | A * | 10/2000 | Gannon | 340/649 |
| 6,272,694 | B1 | 8/2001 | Weaver et al. | |
| 6,510,987 | B1 | 1/2003 | Hengriprasopchoke et al. | |
| 6,577,287 | B2 * | 6/2003 | Havel | 345/83 |
| 6,714,814 | B2 | 3/2004 | Yamada et al. | |
| 6,767,603 | B1 * | 7/2004 | Hurst et al. | 428/36.1 |
| 6,809,522 | B2 | 10/2004 | Nguyen | |
| 2004/0198117 | A1 | 10/2004 | Caudell | |
| 2005/0278826 | A1 | 12/2005 | Kato | |
| 2006/0261818 | A1 | 11/2006 | Zank et al. | |

OTHER PUBLICATIONS

Office Action dated Feb. 11, 2009 from U.S. Appl. No. 11/508,766, 30 pages.

Office Action dated Jun. 8, 2009 from U.S. Appl. No. 11/508,766, 7 pages.

Office Action dated Oct. 23, 2008 from U.S. Appl. No. 11/700,427, 17 pages.

Office Action dated Apr. 2, 2009 from U.S. Appl. No. 11/700,427, 20 pages.

Notice of Allowance dated Oct. 7, 2009 from U.S. Appl. No. 11/700,427, 10 pages.

Notice of Allowance dated Oct. 23, 2009 from U.S. Appl. No. 11/700,427, 11 pages.

Office Action dated Nov. 12, 2009 from U.S. Appl. No. 11/508,766, 12 pages.

Office Action dated Mar. 31, 2010 from U.S. Appl. No. 12/356,204, 31 pages.

Notice of Allowance dated Sep. 9, 2010 from U.S. Appl. No. 12/356,204, 9 pages.

Notice of Allowance dated Nov. 8, 2010 from U.S. Appl. No. 11/508,766, 9 pages.

* cited by examiner

MONITORING DEVICE FOR USE WITH AN INSULATED DUAL PORTION GARMENT

CROSS-REFERENCE TO RELATED APPLICATIONS

This application is a continuation-in-part of U.S. patent application Ser. No. 11/508,766, filed Aug. 23, 2006, which is incorporated by reference in its entirety.

BACKGROUND

1. Field

The present invention relates to static control garments and monitoring devices. In particular, the present invention relates to a monitoring device for use with an insulated dual portion garment.

2. Description of the Related Art

Static electricity represents a serious threat to electronic components, which may become damaged during the manufacturing process when the personnel handling these components are not effectively grounded. It is desirable to ground not only the bodies of the personnel working with these components, but their clothing as well, as charge can build up in either location.

The "bunny suit" is a popular garment used to ground personnel and their clothing. Typically, the bunny suit is made from a knit or woven fabric comprising an electrically conductive Faraday cage grid. The garment thereby effectively shields the personnel and his or her clothing from delicate electronic components. One or more close fitting connections may also be used to electrically couple the wearer's body to the bunny suit and/or to ground. For example, a wrist strap having an attached grounding cord may be incorporated into the bunny suit in order to couple the wearer's body to ground.

Unfortunately, the conventional bunny suit is not ideal. For example, in order to determine whether or not the bunny suit is effectively grounding its wearer, two connections should couple the wearer to a monitoring circuit. However, because the entire garment is made from electrically conductive material, a number of uncontrolled parallel electrical paths are formed between the wearer's body, street clothing and bunny suit, and the monitoring circuit. These parallel paths can make the monitoring circuit's output unreliable.

Moreover, the grounding of the bunny suit is typically only tested occasionally. The use of conventional monitoring circuits is inconvenient (often requiring the wearer to manually touch a ground, for example, to define a current loop), and they may be located far from where the wearer is working with the electronic components.

The prior art has not disclosed an effective way of monitoring the status of a wearer's connection to ground. The prior art has also not disclosed an effective way to ameliorate the problem of multiple, uncontrolled parallel electrical paths undermining the accuracy of ground monitoring.

DETAILED DESCRIPTION OF EMBODIMENTS OF THE INVENTION

Figure 1A:
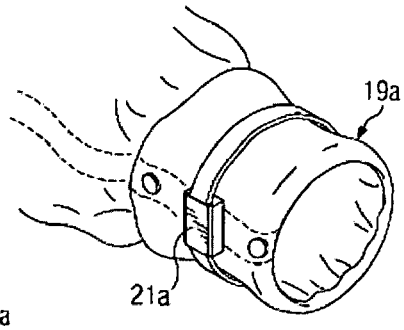
FIG. 1A shows an enlarged view of one cuff of the labcoat of FIG. 1.
Figure 1:
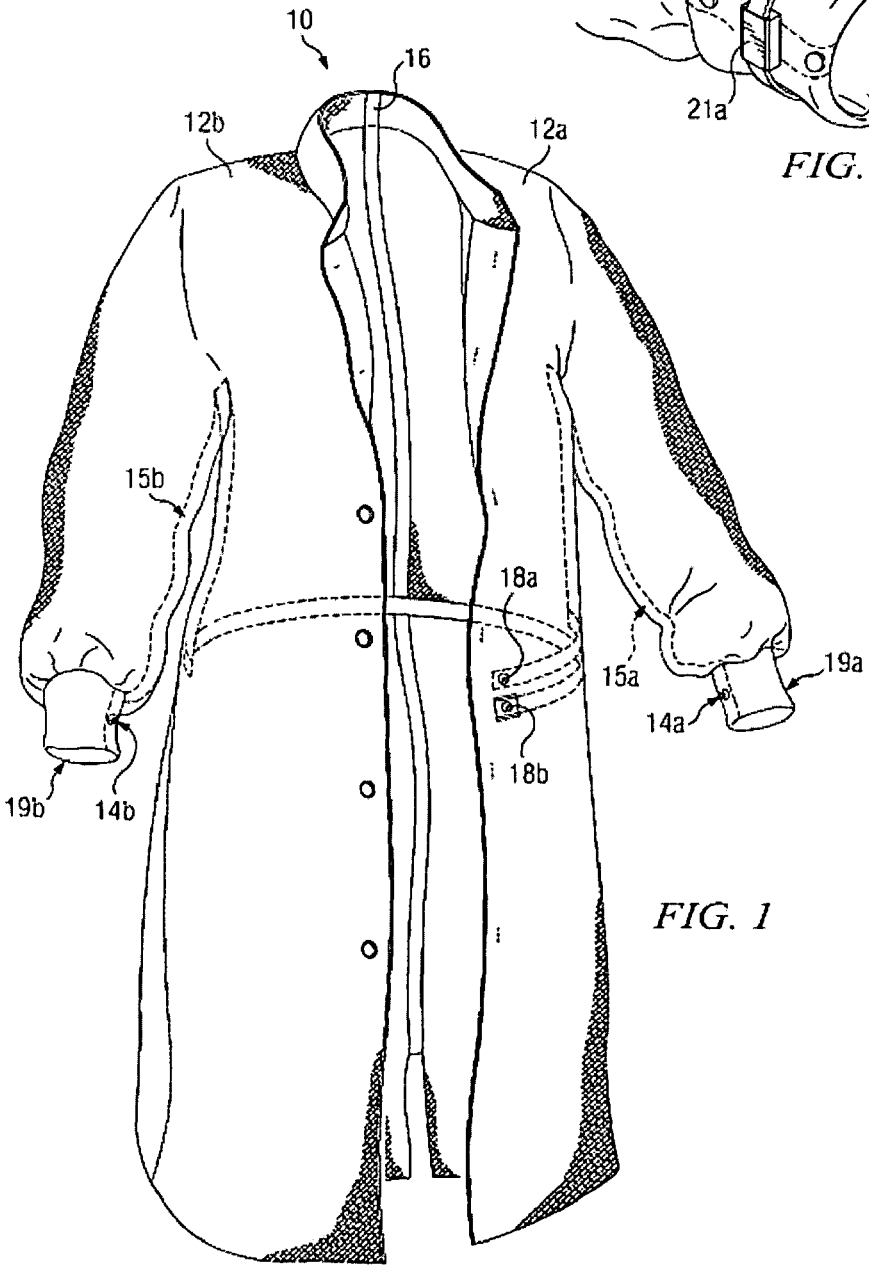
FIG. 1 shows a perspective view of a static control garment, a labcoat, according to one embodiment of the present invention.

Referring to FIG. 1, a static control garment configured to be worn by a user (not shown) is illustrated according to one embodiment of the present invention. As shown in FIG. 1, the garment comprises a labcoat 10, although other configurations (such as that shown in FIG. 3) may also be used. The labcoat 10 comprises first and second conductive portions 12*a*, 12*b*, a first user interface 14*a* for electrically coupling the first conductive portion 12*a* to the user, a second user interface 14*b* for electrically coupling the second conductive portion 12*b* to the user, and an insulative portion 16 coupled to and separating the first and second conductive portions 12*a*, 12*b*. In one embodiment, the first and second conductive portions 12*a*, 12*b* comprise substantially the same amount of conductive material.

As illustrated, the labcoat 10 may generally extend to around the mid-thigh of the user, and may be buttoned up the front using buttons made of an insulative material. However, this particular style of static control garment is shown solely for purposes of illustration, since the shape and style of the garment may be varied.

The first and second conductive portions 12*a*, 12*b* may be made from any relatively conductive fabric. In one embodiment, each of the conductive portions 12*a*, 12*b* comprises a knit or woven fabric including therein an electrically conductive and dissipative Faraday cage grid. For example, polyester carbon-infused nylon may be woven into a conductive grid pattern throughout each of the conductive portions. Thus, the nylon grid forms an electrically conductive carbon mesh that shields electrical components being worked on from the radiation of static electricity from a user's "street" clothing worn under the static control garment. In another embodiment, the fabric may comprise polyester, nylon, cotton or other synthetic or non-synthetic materials, or a blend of these fabrics. Running through these materials, conductive threads of copper, stainless-steel, carbon or silver-loaded filaments, or other metallic or non-metallic conductive elements may also comprise the conductive portions.

In some embodiments, the first and second conductive portions 12*a*, 12*b* may be made from different conductive materials having similar electrical properties, but in other embodiments, the same material is used to manufacture both portions. In one embodiment, the conductive material used to make these conductive portions 12*a*, 12*b* has a resistance of less than $10^9$ ohms per square, but preferably not less than $10^3$ ohms per square.

Figure 3:
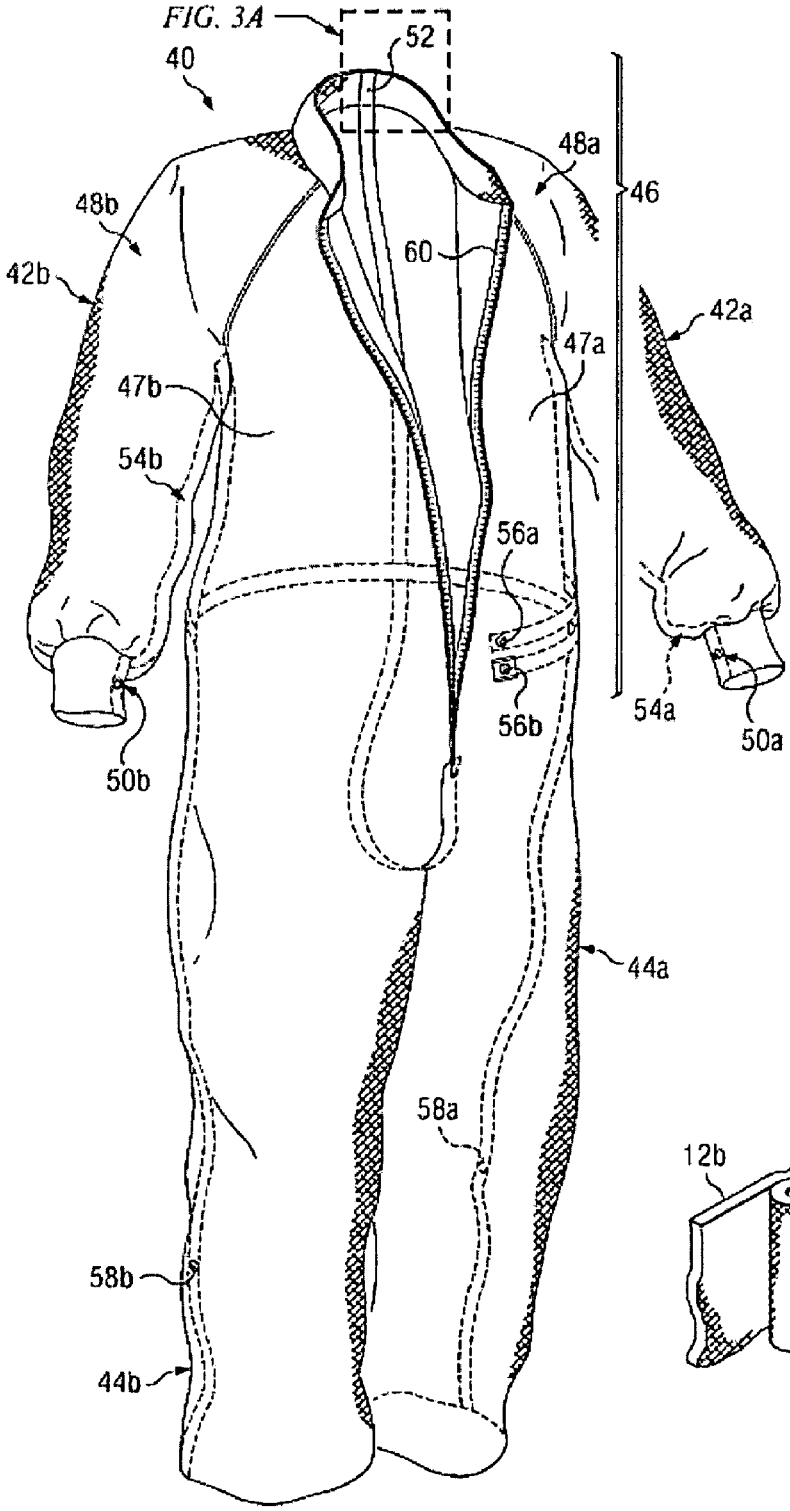
FIG. 3 shows a perspective view of a static control garment, a bunny suit, according to another embodiment of the present invention.

While the first and second conductive portions 12*a*, 12*b* are illustrated as each making up nearly all of one half of the labcoat 10, it should be understood that the first and second conductive portions may, in other embodiments, comprise substantially less material. Thus, a significant percentage of the static control garment may comprise non-conductive material (e.g., the sleeves may not be conductive in one embodiment, or the legs of a bunny suit (as illustrated in FIG. 3) may not be conductive in another embodiment). Preferably, however, the majority of each half of the labcoat does comprise conductive material, in order to effectively shield more of the user's body using the garment as a Faraday cage.

The first user interface 14*a* electrically couples the first conductive portion 12*a* to the user when the garment is worn. It may accomplish this electrical connection in any of a variety of ways. In one embodiment, as illustrated in FIG. 1A (which shows the cuff 19*a* inverted), the first user interface 14*a* comprises a metal plate 21*a* on the inside of a cuff 19*a* of the labcoat 10. The cuff 19*a* may include elastic, stretchable material to compress the cuff 19*a* against a user's skin when worn. Thus, the metal plate 21*a* of the first user interface 14*a* is also pressed against the bare skin of the user's wrist, creating an electrical connection between the user and the first user interface 14*a*. In one embodiment, multiple metal plates 21*a* are provided to form the first user interface 14*a*, such that redundant electrical connections are made between the user and the static control garment.

In another embodiment, the elastic material comprising the cuff 19*a* may itself be electrically conductive and may thereby comprise the first user interface 14*a*. In still another embodiment, the user may wear a separate wristband, and a first user interface 14*a* of the labcoat 10 may couple to this separate wristband (via snaps, wires, or other means) and be thereby electrically coupled indirectly to the user. Preferably, the user interface 14*a* couples to the user at the user's wrist because this is a portion of the user's body often left bare by street clothing. However, in other embodiments, the user interface 14*a* may couple to any body part to facilitate a relative secure electrical connection.

The first user interface 14*a* may be directly coupled to the first conductive portion 12*a*, and may be understood to form a part of the first conductive portion 12*a*. For example, the cuff 19*a* may comprise part of the first conductive portion 12*a*, and the metal plate 21*a* comprising the first user interface 14*a* may be in direct electrical contact with the cuff 19*a*. In another embodiment (shown in FIG. 1), the first conductive portion 12*a* includes therein a ribbon of conductive material 15*a* that is not electrically isolated from the rest of the conductive portion 12*a*. This ribbon of conductive material 15*a* may be sewn into a seam of the first conductive portion 12*a*, as illustrated. The ribbon 15*a* may be formed from any of a variety of conductive materials, and in one embodiment comprises carbon-infused nylon. In other embodiments, carbon or copper-based conductive threads, ribbons or metal/metal-infused tapes may be used to form the ribbon 15*a*. The first user interface 14*a* may electrically contact the ribbon 15*a*, and may thereby electrically couple the user to the first conductive portion 12*a* through the ribbon.

In one embodiment, the second user interface 14*b* is configured identically to the first user interface 14*a*, just on the other side of the garment. However, in other embodiments, of course, the two interfaces may be configured differently.

Figure 3A:
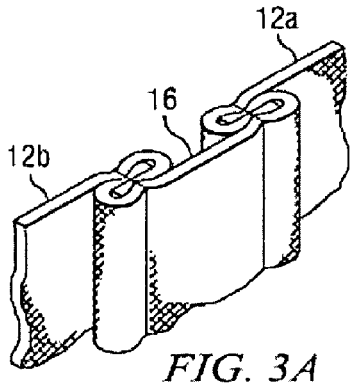
FIG. 3A shows an enlarged cut-away of a seam of the bunny suit of FIG. 3.

The insulative portion 16 is coupled to both the first and second conductive portions 12*a*, 12*b*, and generally separates them. The insulative portion 16 may be coupled to the conductive portions 12*a*, 12*b* by a variety of methods used in the garment industry. For example, as illustrated in FIG. 3A, the insulative portion 16 may be folded together with each conductive portion in a double felt configuration, and then joined by any of a number of stitches. Lock, common-tailor or other stitches, staples, glue, or other affixing means may also be used to couple the insulative portion 16 to the first and second conductive portions 12*a*, 12*b*.

In one embodiment, the insulative portion 16 runs generally along a midline of the user's torso. However, in other embodiments, the insulative portion may be offset to one side of the user's torso or another according to the needs (aesthetic or technical) of a particular implementation. Indeed, while the insulative portion 16 is shown along a vertical midline, the insulative portion 16 may also run generally along a horizontal midline. In one embodiment, the insulative portion 16 may comprise a polyester material without conductive elements therethrough, so that the insulative portion and conductive portions have substantially similar wash-and-dry properties. However, other fabrics may also be used, including polyester, nylon, cotton or other synthetic or non-synthetic materials, or a blend of these fabrics.

The insulative portion 16 is located between the first and second conductive portions 12*a*, 12*b* as illustrated in FIG. 1. However, it need not completely isolate these conductive portions from each other. For example, in one embodiment, as illustrated, the first and second conductive portions 12*a*, 12*b* may come into momentary contact with each other if one conductive portion of the labcoat 10 rubs against the other conductive portion. As another example, when the labcoat 10 is worn, it may be buttoned up the front, and the first and second conductive portions 12*a*, 12*b* may be placed in relatively constant contact with each other. However, the first and second conductive portions 12*a*, 12*b* are preferably not sewn together or otherwise relatively permanently attached except through insulative material. In some embodiments, the labcoat may use insulated buttons, as shown in FIG. 1, or a zipper may be used that includes an insulative fabric to provide further isolation between the two sides of the garment (see FIG. 3). Preferably, even if the first and second conductive portions 12*a*, 12*b* come into contact with each other, there is a much higher resistance to this contact than if they were a unitary piece.

In one embodiment, as set forth above, the first and second conductive portions 12*a*, 12*b* comprise substantially the same amount of conductive material. For example, the two portions may comprise the same amount of conductive material within manufacturing tolerances for manufacturing the garment. In another embodiment, the first and second conductive portions 12*a*, 12*b* comprise substantially the same amount of conductive material, such that the capacitance between each conductive portion of the garment and ground is approximately the same (within 10%).

In another embodiment, the amounts of material in the first and second conductive portions 12*a*, 12*b* do not differ by more than 30%. In another embodiment, the amounts of material in the first and second conductive portions 12*a*, 12*b* do not differ by more than 20%. In yet another embodiment, the amounts of material in the first and second conductive portions 12*a*, 12*b* do not differ by more than 10%. In yet another embodiment, the amounts of material in the first and second conductive portions 12*a*, 12*b* do not differ by more than 5%. It may be understood that different monitoring devices that may be used to ensure that the user and garment are effectively grounded may be more or less sensitive to differing amounts of material for the first and second conductive portions 12*a*, 12*b*. Thus, in some environments, the amounts of material in the first and second conductive portions 12*a*, 12*b* should not differ by more than 5%, while in other environments, this requirement may be relaxed.

Figure 2:
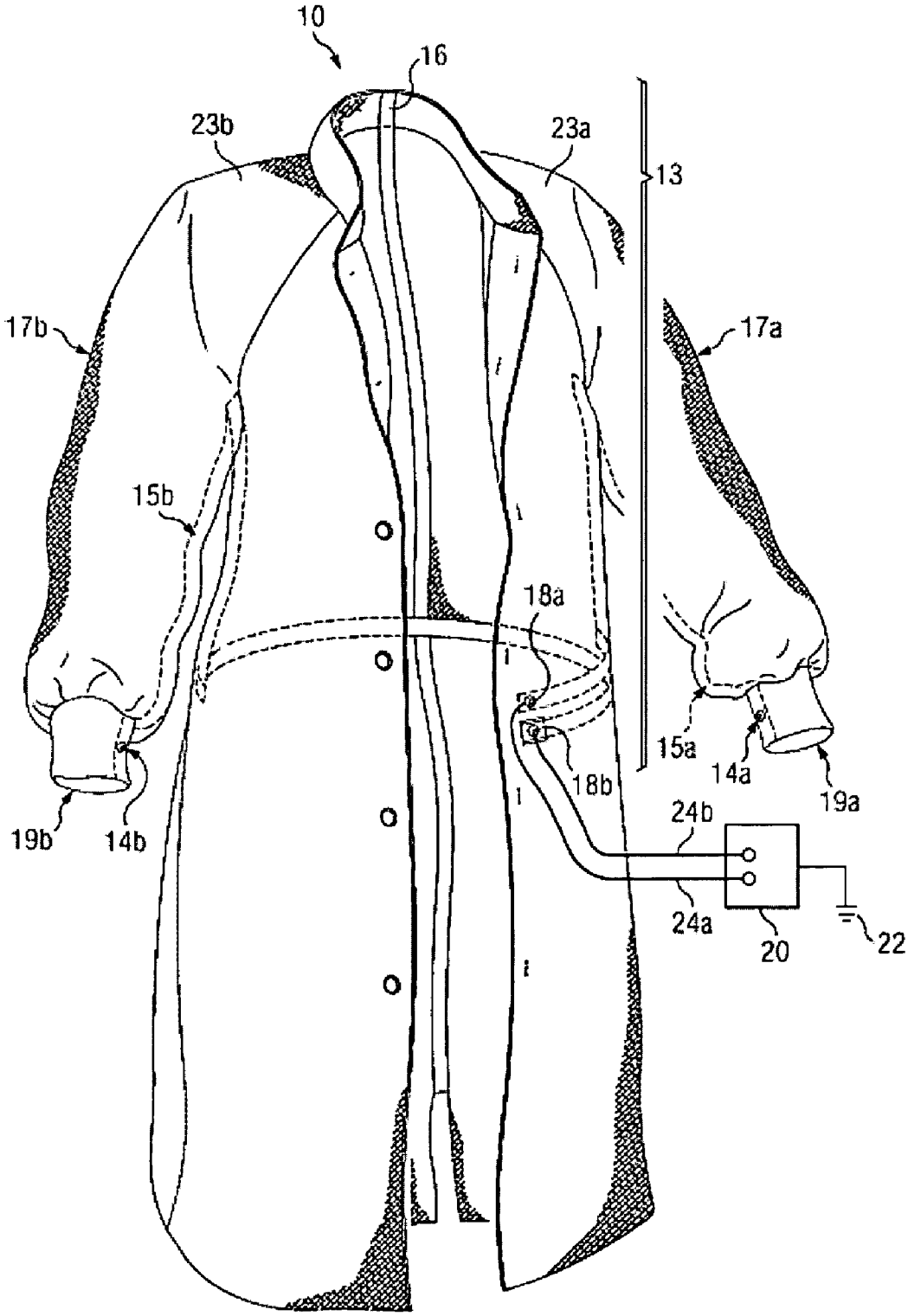
FIG. 2 shows a perspective view of the labcoat of FIG. 1 coupled to a monitoring device.

Referring to FIG. 2, the labcoat 10 may be further understood to include a torso portion 13, and first and second arm portions 17*a*, 17*b*. In one embodiment, the torso portion 13 of the labcoat 10 comprises first and second conductive portions 23*a*, 23*b*, which are separated by the insulative portion 16. As illustrated, the first and second conductive portions 23*a*, 23*b* that comprise the torso portion 13 form a part of the larger first and second conductive portions 12*a*, 12*b* (illustrated in FIG. 1), which are discussed at length above. Thus, in one embodiment, the first and second conductive portions 12*a*, 12*b* comprise material from the respective arm portions 17*a*, 17*b*, as well as the first and second conductive portions 23*a*, 23*b* of the torso portion 13.

Of course, different configurations are possible. For example, the first and second arm portions 17*a*, 17*b* need not be made from conductive material. In one embodiment, the first and second arm portions 17*a*, 17*b* may comprise conductive fabric, but may each be electrically uncoupled from the torso portion 13.

Referring further to FIG. 2, the labcoat 10 may further comprise first and second electrical interfaces 18*a*, 18*b* for electrically coupling to a monitoring device 20. In one embodiment, as shown, leads 24*a*, 24*b* run from both electrical interfaces 18*a*, 18*b* to the monitoring device 20. In other embodiments, only one of the electrical interfaces need be coupled to a monitoring device. These electrical interfaces 18*a*, 18*b* may be configured in a variety of ways. For example, the electrical interfaces 18*a*, 18*b* may comprise metallic snaps to which the monitoring device 20 can attach by leads 24*a*, 24*b* having mating connectors. In another embodiment, the electrical interfaces 18*a*, 18*b* comprise female receptacles for banana plugs coupled to the monitoring device 20. Any other suitable electrical interfaces may be used to couple the labcoat 10 and monitoring device 20.

A number of monitoring devices may be used with the labcoat 10 illustrated in FIGS. 1 and 2. In one embodiment, a monitoring device 20 may periodically send a current through a first lead, and receive a current through a second lead. The monitoring device 20 may thereby derive a resistance measurement of the circuit formed by the garment and user. If a large resistance is detected, an alarm may be triggered indicating that the user of the garment is not properly grounded. In another embodiment, a monitoring device, such as a Dual Wire Continuous Monitor, Part No. 19665, produced by Desco Industries, Inc., may be used. Other monitoring devices differently configured may also be used.

The monitoring device 20 may be coupled to the labcoat 10 while the user moves around performing job functions, or the monitoring device 20 may only be coupled to the labcoat 10 at particular ESD testing stations (not shown), so that grounding of the labcoat 10 is tested more intermittently.

As illustrated in FIG. 2, the first user interface 14*a* may be electrically coupled to the first electrical interface 18*a*, and the second user interface 14*b* may be electrically coupled to the second electrical interface 18*b*. Any electrical connection may be used. As illustrated, the first user interface 14*a* and first electrical interface 18*a* are coupled by the ribbon of conductive material 15*a*. Similarly, the second user interface 14*b* and second electrical interface 18*b* are coupled by a ribbon of conductive material 15*b* extending through the labcoat 10. In one embodiment, the two ribbons 15*a*, 15*b* are made from the same material.

As is also illustrated in FIG. 2, the second electrical interface 18*b* may be surrounded by the first conductive portion 12*a*. In fact, as shown in the Figure, the second electrical interface 18*b* is embedded within the material that comprises the first conductive portion 12*a*. However, in one embodiment, the second electrical interface 18*b* remains insulated from the first conductive portion 12*a*. Thus, as shown, the ribbon 15*b* may pass through the second conductive portion 12*b* through a non-insulated seam, and, as it passes through the insulative portion 16 and into the first conductive portion 12*a*, a strip of insulative material preferably surrounds and insulates the ribbon 15*b* from the first conductive portion 12*a* surrounding it. Other means of electrically isolating the ribbon 15*b* may be used in other embodiments. Similarly, the second electrical interface 18*b*, although surrounded by the first conductive portion 12*a*, is preferably electrically isolated from the first conductive portion 12*a* by insulative materials.

Preferably, the first and second electrical interfaces 18*a*, 18*b* are located adjacent one another and are surrounded by the first conductive portion 12*a*. Such a configuration facilitates creating an electrical connection between the labcoat 10 and monitoring device 20, as the user can quickly and easily attach and detach the leads from his waist.

Referring to FIG. 3, the static control garment may alternatively comprise a bunny suit 40. Such a bunny suit 40 comprises arms 42*a*, 42*b*, legs 44*a*, 44*b*, and a torso portion 46. In a preferred embodiment, the torso portion 46 further comprises first and second conductive torso portions 47*a*, 47*b* separated by an insulative portion 52.

The bunny suit 40 may be further described as comprising first and second conductive portions 48*a*, 48*b* (which include the first and second conductive torso portions 47*a*, 47*b* of the torso portion 46 respectively), a first user interface 50*a* for electrically coupling the first conductive portion 48*a* to the user, a second user interface 50*b* for electrically coupling the second conductive portion 48*b* to the user, and an insulative portion 52 coupled to and separating the first and second conductive portions 48*a*, 48*b*. In one embodiment, the first and second conductive portions 48*a*, 48*b* comprise substantially the same amount of conductive material.

The materials and structures comprising the bunny suit 40 may be generally the same as those discussed above used to construct different embodiments of the labcoat 10. However, in a preferred embodiment, the legs 44*a*, 44*b* of the bunny suit 40 form part of the first and second conductive portions 48*a*, 48*b*, respectively. Secondly, as illustrated, a zipper 60 may be used to close the bunny suit 40 when worn, in order to provide further insulation between the two conductive portions 48*a*, 48*b* of the bunny suit 40. Thirdly, the ribbons of conductive material 54*a*, 54*b*, coupling the user interfaces 50*a*, 50*b* to the electrical interfaces 56*a*, 56*b*, respectively, may extend down the legs 44*a*, 44*b* of the bunny suit 40 in one embodiment.

Near the bottom of the bunny suit 40, these ribbons of conductive material 54*a*, 54*b* may be electrically coupled to a pair of bootie interfaces 58*a*, 58*b*. The bootie interfaces 58*a*, 58*b* may be configured in a variety of ways in order to support an electrical connection between the bunny suit 40 and a pair of booties 62*a*, 62*b* (such as those shown in FIGS. 4 and 5). For example, in one embodiment, the bootie interfaces 58*a*, 58*b* comprise metallic snaps (which may be identical to the electrical interfaces 56*a*, 56*b*) to which the booties 62*a*, 62*b* can attach by mating connectors.

Figure 4:
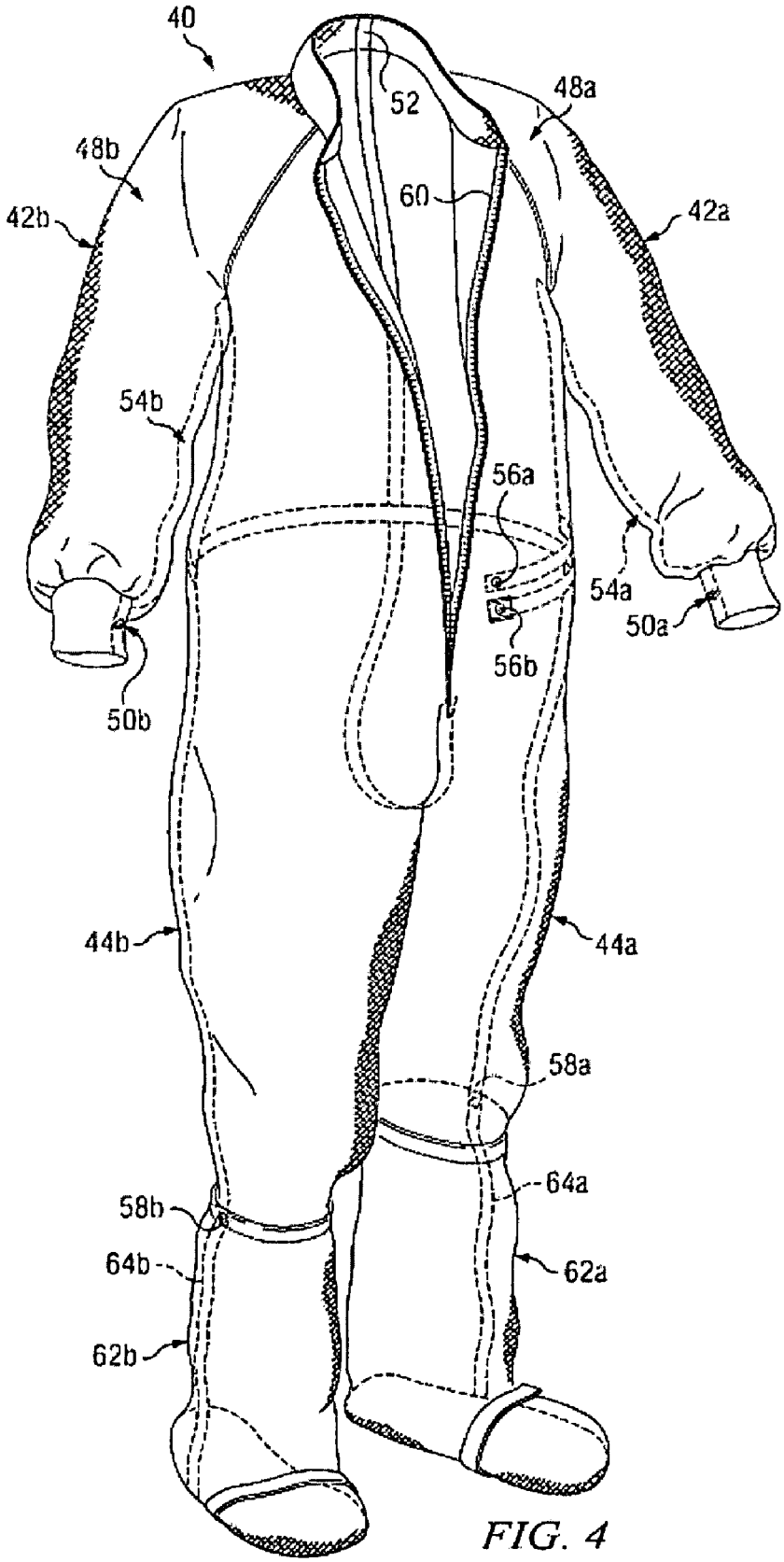
FIG. 4 shows a perspective view of the bunny suit of FIG. 3 including a coupled pair of booties.
Figure 5:
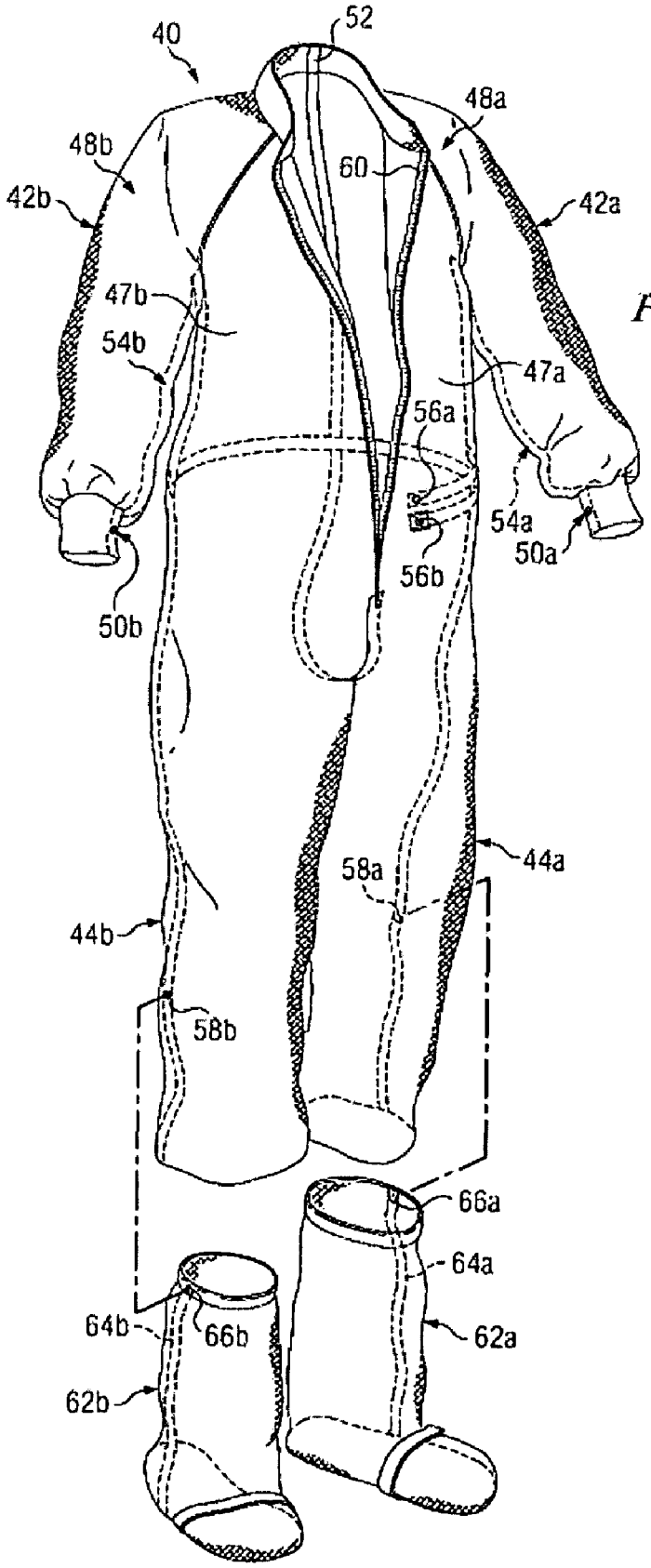
FIG. 5 shows a perspective view of the bunny suit and the booties of FIG. 4, in an uncoupled configuration.

Referring to FIGS. 4 and 5, the first conductive portion 48*a* may comprise a first bootie 62*a*, and the second conductive portion 48*b* may comprise a second bootie 62*b*. These booties 62*a*, 62*b* preferably shield the user's feet, and ensure that excess charge does not build up and discharge via the user's shoes. In one embodiment, the fabric comprising the top portions of the booties 62*a*, 62*b* is the same material comprising the rest of the first and second conductive portions 48*a*, 48*b*, and the booties 62*a*, 62*b* have rubber soles. Of course, other configurations for the booties are possible.

Referring to FIG. 4, the first and second booties 62*a*, 62*b* are illustrated as electrically coupled to the bunny suit 40. In one embodiment, the ribbon of conductive material 54*a* is coupled through a bootie interface 58*a* of the bunny suit 40 to a corresponding ribbon of conductive material 64*a* running through the bootie 62*a*. The other bootie 62*b* is configured similarly. Thus, the entire first conductive portion 48*a* may be understood to include the arm 42*a*, one side of the torso portion 46, the leg 44*a*, and the bootie 62*a*. In FIG. 5, the first and second booties 62*a*, 62*b* are illustrated in an uncoupled configuration, with the first and second bunny interfaces 66*a*, 66*b* visible. The first and second bunny interfaces 66*a*, 66*b* are preferably configured to correspond with and engage the first and second bootie interfaces 58*a*, 58*b* respectively to create an electrical connection.

Figure 6:
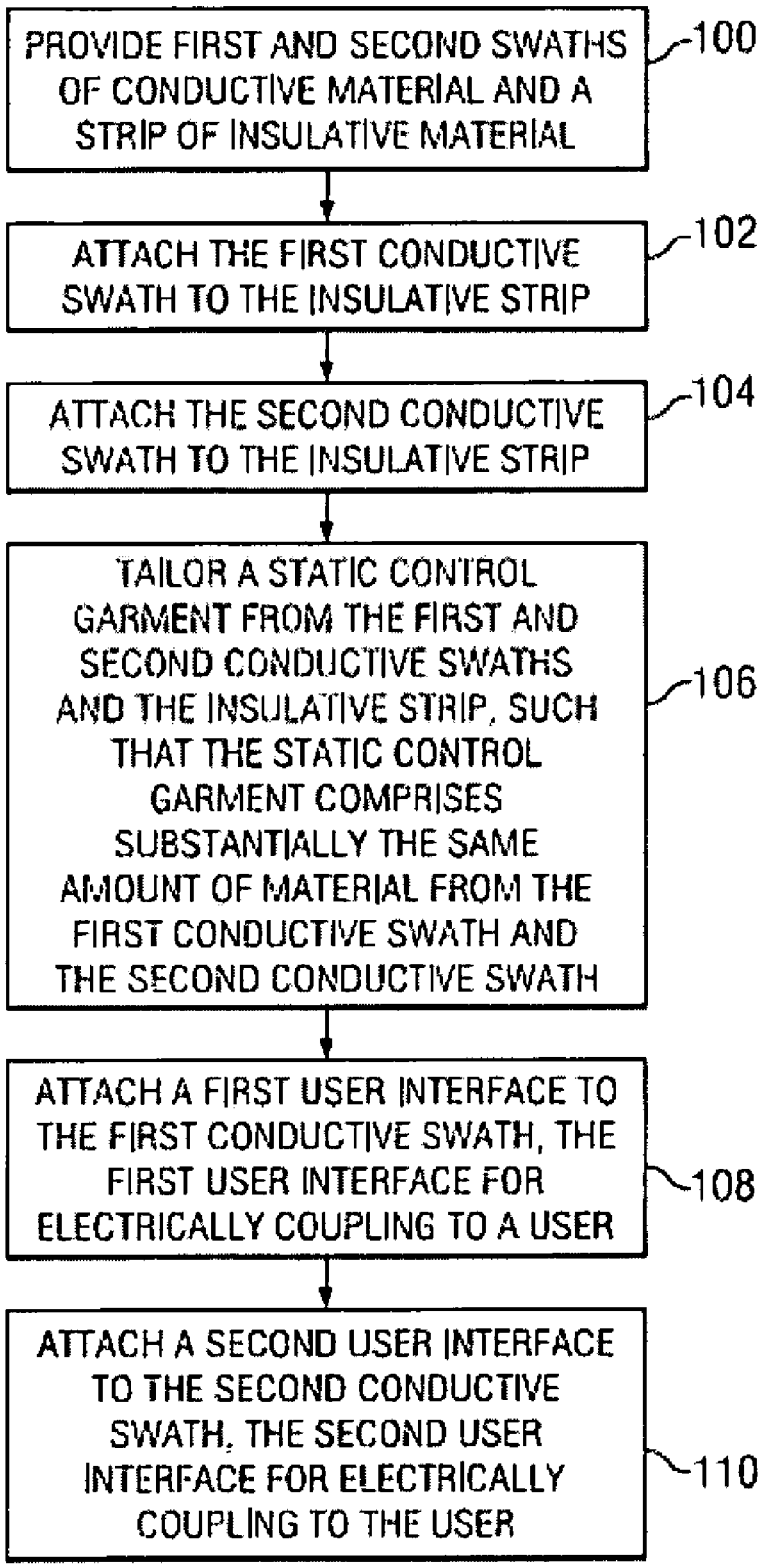
FIG. 6 illustrates the steps of one method of manufacturing a static control garment according to one embodiment of the present invention.

Referring to FIG. 6, a flow chart illustrating the steps of a method of manufacturing a static control garment according to one embodiment of the invention is set forth. As illustrated, the method may comprise: providing first and second swaths of conductive material and a strip of insulative material (step 100); attaching the first conductive swath to the insulative strip (step 102); attaching the second conductive swath to the insulative strip (step 104); tailoring a static control garment from the first and second conductive swaths and the insulative strip, such that the static control garment comprises substantially the same amount of material from the first conductive swath and the second conductive swath (step 106); attaching a first user interface to the first conductive swath, the first user interface for electrically coupling to a user (step 108); and attaching a second user interface to the second conductive swath, the second user interface for electrically coupling to the user (step 110).

As shown at step 100, first and second swaths of conductive material and a strip of insulative material are first provided. As discussed at length above, in one embodiment, the swaths of conductive material comprise polyester carbon-infused nylon, but may alternatively comprise any conductive fabric. The swaths of conductive material preferably include a continuous grid of conductive filaments. The strip of insulative material may also comprise any insulative fabric, and, in one preferred embodiment, comprises polyester.

The swaths of conductive material may be provided in many forms. In one embodiment, the fabric is sold in large rolls from which the swaths of conductive material may be cut. In one embodiment, the first and second swaths of conductive material comprise the same swath of conductive material until they are separated. The strip of insulative material may also be provided in many forms. It need not be uniform, and may vary greatly in dimension. In one embodiment, the strip of insulative material may be approximately 4 feet long and 1 inch wide.

At step 102, the first conductive swath is attached to the insulative strip. The means of attaching these two materials are well-known to those of skill in the art. In one embodiment, they are sewn together as is shown in FIG. 3A.

At step 104, the second conductive swath is attached to the insulative strip. Preferably, the two materials are attached identically to the method used in step 102, although variations are acceptable. The first and second conductive swaths are preferably attached to the same insulative strip, but are not attached directly to one another. In one embodiment, the first and second conductive swaths are attached to the insulative strip in order to insulate them from each other.

At step 106, the static control garment is tailored from the first and second conductive swaths and the insulative strip. Suitable tailoring processes are well-known in the art. In one embodiment, the swaths and strip are first cut, and then stitched together in order to create a garment that is wearable. For example, the swaths and insulative strip may be tailored to create a bunny suit 40 (such as that shown in FIG. 3) or a labcoat 10 (such as that shown in FIG. 1). In certain embodiments, the tailoring yields at least a torso portion for surrounding the user's torso, and two arm portions for covering the user's arms.

During this tailoring step, the static control garment may be tailored to comprise substantially the same amount of material from the first conductive swath and the second conductive swath. Of course, the amount of material used from each swath will not be exactly the same due at least to manufacturing tolerances. The static control garment may be understood to be tailored from substantially the same amount of material from the first and second conductive swaths if it satisfies at least one of the criteria set forth above in great detail. In one embodiment, the tailoring is performed such that the insulative strip runs down a user's torso, and, in one embodiment, down a mid-line of a user's body, thereby roughly ensuring that the material from each conductive swath will be approximately the same.

At step 108, a first user interface is attached to the first conductive swath, the first user interface for electrically coupling to the user. As discussed above, the first user interface may include a metal plate that may be pressed against a user's skin. In another embodiment, the second user interface may comprise a cuff, such as an elastic, stretchable cuff incorporated into the garment.

At step 110, a second user interface is attached to the second conductive swath, the second user interface for electrically coupling to the user. Preferably, the second user interface is generally constructed and attached in a manner similar to the first user interface discussed above.

Referring again to FIG. 2, another embodiment of the present invention comprises a method of monitoring a user wearing a static control garment 10 (a labcoat in the embodiment shown). The garment 10 comprises a first and second conductive upper body portions 23*a* and 23*b*, each of which may comprise a torso portion alone, or a torso portion and a sleeve portion as shown in FIG. 2. The garment further includes a first and second electrical interfaces 18*a* and 18*b*, a first user interface 14*a* for electrically coupling the first conductive upper body portion 23*a* to a first upper limb of the user, a second user interface 14*b* for electrically coupling the second conductive upper body portion 23*b* to a second upper limb of the user, and an insulative portion 16 for electrically insulating the first conductive upper body portion 23*a* from the second conductive upper body portion 23*b*. To monitor the user and garment 10, the user touches the first electrical interface 18*a* to a first lead 24*a* of a monitoring device 20, and touches the second electrical interface 18*b* to a second lead 24*b* of the monitoring device 20.

In the embodiment shown in FIG. 2, the first lead 24*a* and second lead 24*b* of the monitoring device 20 comprise wires that may be coupled to the electrical interfaces 18*a* and 18*b* in any suitable manner, such as with snaps or clips. In one embodiment, one of the first or second leads 24*a* and 24*b* is connected to ground 22 in order to ground the user while wearing the garment 10. In this embodiment, the user is "tethered" to the monitoring device 20 while operating at a work station and monitored continuously to ensure proper grounding. In an alternative embodiment, the garment is tethered to ground (via electrical interfaces 18*a* or 18*b*) while the user is at a workstation, and the monitoring device 20 is located at a remote test station. In this embodiment, the user periodically approaches the test station (which may or may not require detaching from ground) to test the soundness of the garment. The user may touch the electrical interfaces to the leads of the monitoring device in any suitable manner to establish an electrical coupling. In one embodiment, the first and second electrical interfaces are located on or near the cuffs 19*a* and 19*b* so that the user can simply touch the cuffs, and thereby the electrical interfaces, to the leads of a monitoring device to perform the test.

The first and second user interfaces 14*a* and 14*b* for electrically coupling the conductive body portions 23*a* and 23*b* to the user may comprise any suitable configuration. In one embodiment, the first user interface 14*a* electrically couples the first conductive upper body portion 23*a* to a first wrist of the user, and the second user interface 14*b* electrically couples the second conductive upper body portion 23*b* to a second wrist of the user. In other embodiments, the user interfaces may electrically couple to first and second hands or at other points along the arms of the user.

Figure 7:
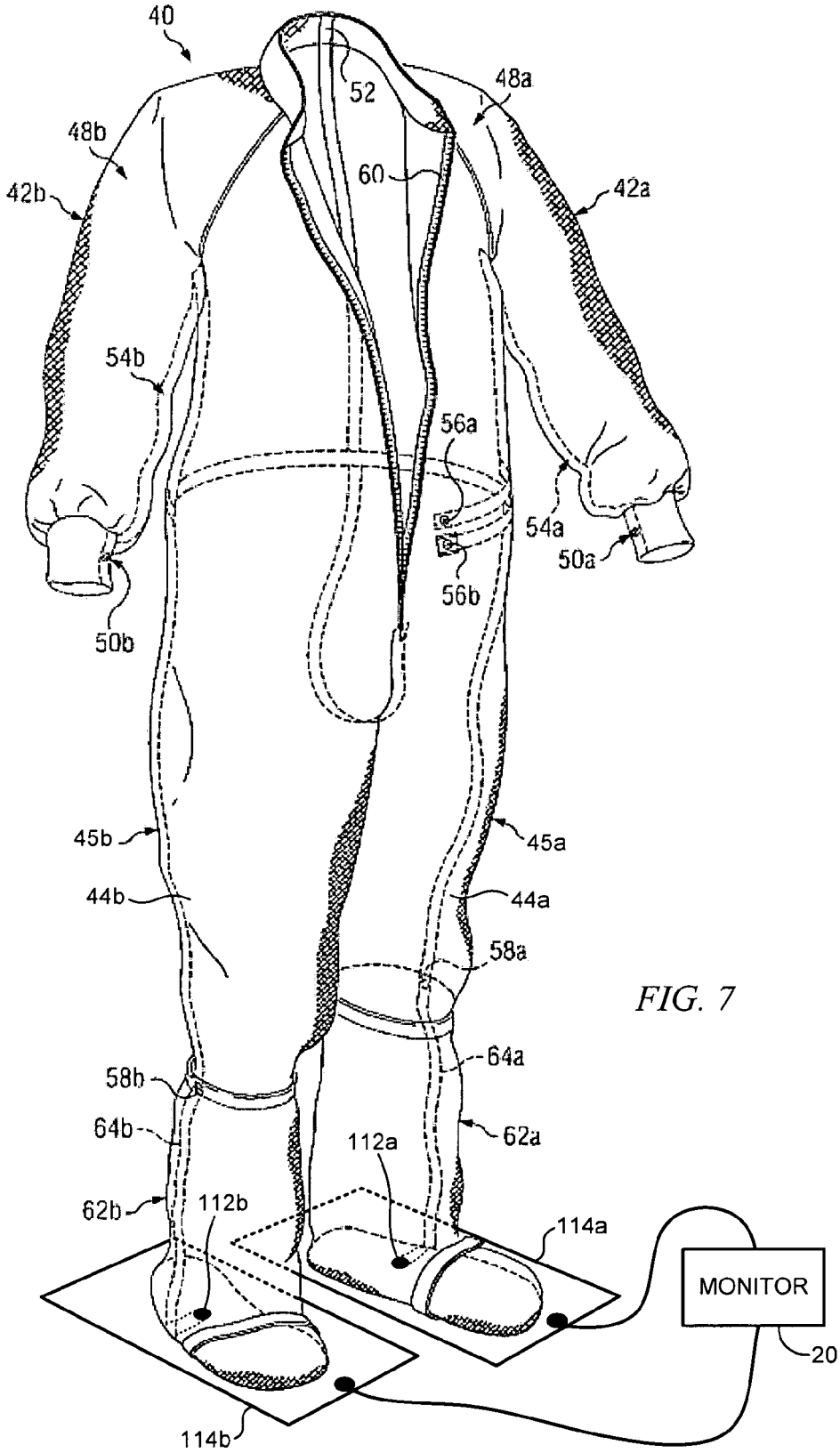
FIG. 7 shows a perspective view of a bunny suit including booties for stepping on respective footpads to monitor the user and garment according to an embodiment of the present invention.

FIG. 7 illustrates another embodiment of the present invention comprising a method of monitoring a user wearing a static control garment 40 (a bunny suit in this embodiment). The garment 40 comprises a first and second conductive lower body portions 45*a* and 45*b*, which may comprise first and second leg portions 44*a* and 44*b* alone, or first and second leg portions 44*a* and 44*b* and first and second booties 62*a* and 62*b*. The garment further includes a first and second electrical interfaces 112*a* and 112*b*, a first user interface for electrically coupling the first conductive lower body portion 45*a* to a first limb of the user, a second user interface for electrically coupling the second conductive lower body portion 45*b* to a second limb of the user, and an insulative portion 52 for electrically insulating the first lower body portion 45*a* from the second lower body portion 45*b*. To monitor the user and the garment 40, the user touches the first electrical interface 112*a* to a first lead 114*a* (e.g., a first footpad) of a monitoring device 20, and touches the second electrical interface 112*b* to a second lead 114*b* (e.g., a second footpad) of the monitoring device 20.

Figure 8:
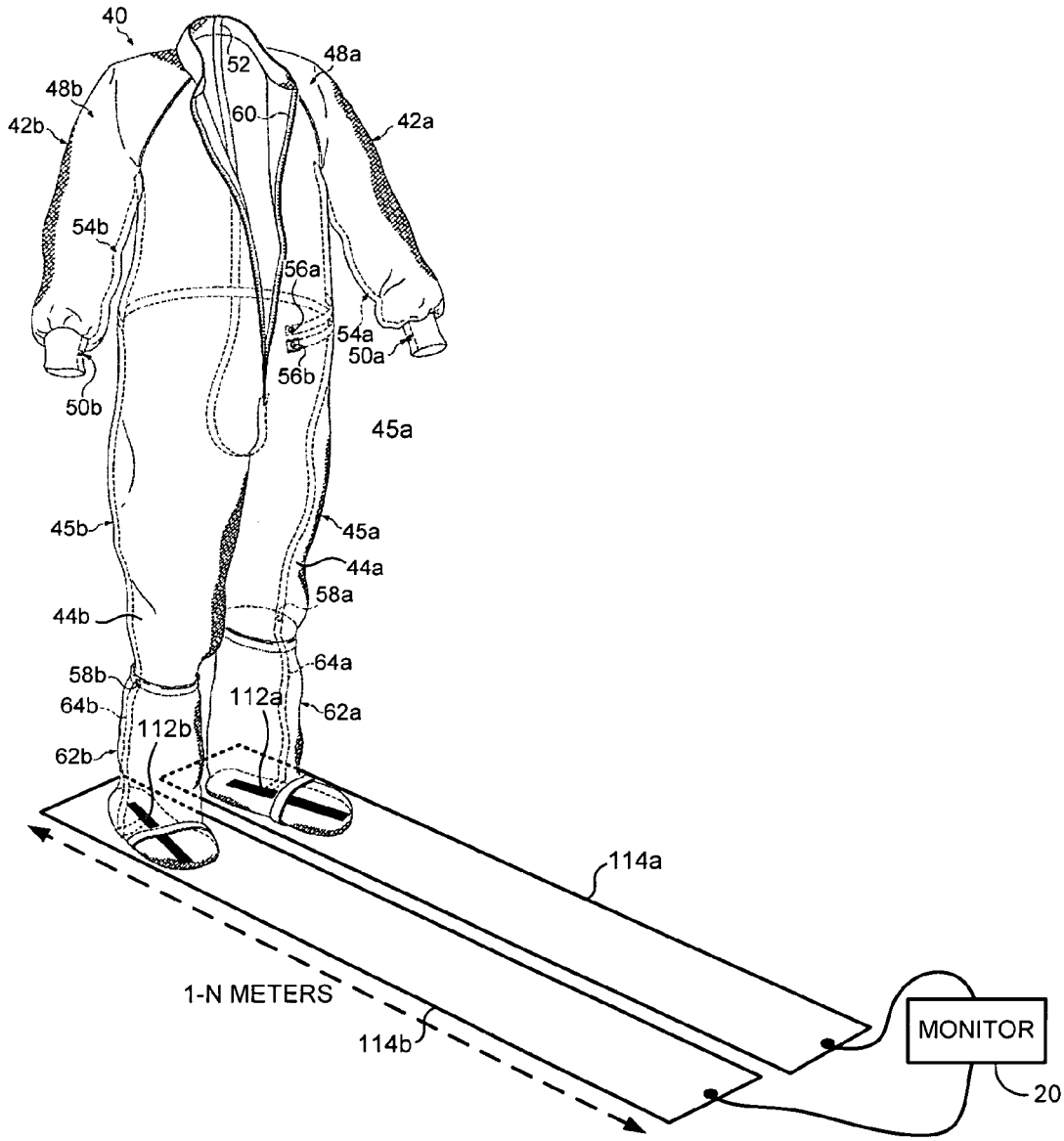
FIG. 8 shows a perspective view of a bunny suit including booties for walking on respective footpads to monitor the user and garment according to an embodiment of the present invention.

In one embodiment, the first user interface electrically couples the first conductive lower body portion 45*a* to a first foot of the user, and the second user interface electrically couples the second conductive lower body portion 45*b* to a second foot of the user. For example, in the embodiment shown in FIG. 7, the first conductive lower body portion 45*a* comprises a first bootie 62*a* wherein the first user interface comprises an insole of the first bootie 62*a*, and the second conductive lower body portion 45*b* comprises a second bootie 62*b* wherein the second user interface comprises an insole of the second bootie 62*b*. A sole of the first bootie 62*a* comprises the first electrical interface 112*a*, and a sole of the second bootie 62*b* comprises the second electrical interface 112*b*. The first and second electrical interfaces 112*a* and 112*b* may comprise any suitable configuration, such as a single point contact as shown in FIG. 7 or a strip of conductive material as shown in FIG. 8. In yet another embodiment, the entire sole of the booties 62*a* and 62*b* comprises a conductive material. In this embodiment, such soles may facilitate the dissipation of static electricity through dissipative flooring while standing at a work station.

In an alternative embodiment also depicted in FIG. 7, the first conductive lower body portion 45*a* may be electrically coupled to the first user interface 50*a* through the fabric of the garment as well as the ribbon of conductive material 54*a*, and the first user interface 50*a* is in turn electrically coupled to the user's body via the user's wrist as discussed in detail above. The second conductive lower body portion 45*b* may be similarly electrically coupled to a second wrist of the user via the second user interface 50*b*.

In one embodiment, to measure the static electricity, the user places the first bootie 62*a* (including the first electrical interface 112*a*) on the first lead 114*a* of the monitoring device 20, and places the second bootie 62*b* (including the second electrical interface 112*b*) on a second lead 114*b* of the monitoring device 20. In one embodiment, the monitoring device 20 is located at a remote test station. While the user is operating at a work station, the garment may be tethered to ground through electrical interfaces 56*a* and 56*b*. The user may then periodically approach the test station (which may or may not require detaching from ground) and stand on the first and second leads 114*a* and 114*b* in order to perform the test. In the embodiment shown in FIG. 7, each of the first and second leads 114*a* and 114*b* (footpads) is at least 6 inches in length to accommodate the user stepping on the footpads.

FIG. 8 illustrates an embodiment of the present invention wherein a length of the first and second leads 114*a* and 114*b* of the monitoring device is at least one meter, wherein the method of monitoring the user and garment further comprises the user walking the first bootie 62*a* on the first lead 114*a* of the monitoring device 20, and the user walking the second bootie 62*b* on the second lead 114*b* of the monitoring device 20. As illustrated in FIG. 8, the user performs the testing by walking from one end of the leads 114*a* and 114*b* (footpads) toward the other end of the leads 114*a* and 114*b*, wherein the garment may pass the soundness test while the outer sole of both booties 62*a* and 62*b* are contacting the respective leads 114*a* and 114*b*. For example, in one embodiment, the monitoring device 20 comprises an ohmmeter for measuring the resistance of the user. The monitoring device may further comprise suitable control circuitry that compensates for intermittent short periods of high resistance due to the user walking along the leads 114*a* and 114*b*.

In one embodiment, the monitoring device 20 is located at the entrance of a work environment so that each individual worker can be tested prior to entering the work environment. If while walking along the first and second leads 114*a* and 114*b* the user is not properly grounded by the garment 40, an alarm is activated (e.g., audible or visual) to notify the user to repair or replace the garment 40 before entering the work environment.

Another embodiment of the present invention comprises a monitoring device for monitoring a user wearing a static control garment 40, the garment 40 comprising a first bootie 62*a* and a second bootie 62*b*. The monitoring device comprises a first footpad 114*a* for interfacing with the first bootie 62*a* of the garment 40, and a second footpad 114*b* for interfacing with the second bootie 62*b* of the garment 40, wherein the first footpad 114*a* is electrically insulated from the second footpad 114*b*. For example, in one embodiment a bottom surface of the first and second footpads 114*a* and 114*b* comprises an insulating material. In another embodiment, the first and second footpads 114*a* and 114*b* are placed on an insulating surface, such as a dissipative flooring having a suitable surface resistance. In one embodiment, insulating the footpads 114*a* and 114*b* from each other enables the monitoring device 20 to measure the resistance between the footpads 114*a* and 114*b* using an ohmmeter. If the garment 40 is properly coupled to the user, and the user stands upon the footpads, the measured resistance will then approximately correspond to the resistance of the user-garment combination.

Figure 9:
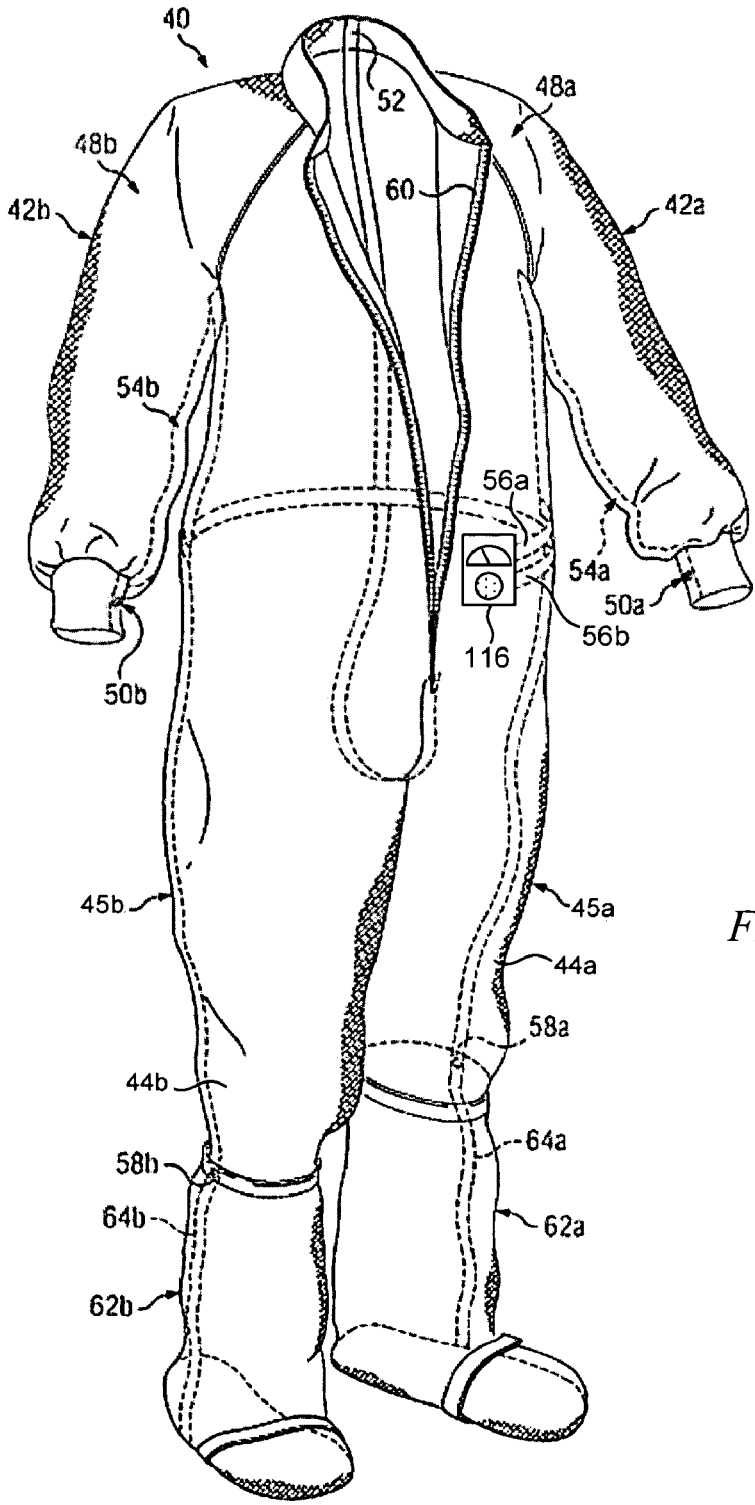
FIG. 9 shows a perspective view of a bunny suit including a wearable monitoring device to enable portable monitoring according to an embodiment of the present invention.

FIG. 9 shows another embodiment of the present invention comprising a static control garment 40 (a bunny suit in this embodiment) configured to be worn by a user. The garment 40 comprises a first conductive body portion 48*a* including a first electrical interface 56*a*, and a second conductive body portion 48*b* including a second electrical interface 56*b*. The garment 40 further comprises a first user interface (e.g., integrated into a cuff 50*a* or a bootie 62*a*) for electrically coupling the first conductive body portion 48*a* to a first limb of the user, and a second user interface (e.g., integrated into a cuff 50*b* or a bootie 62*b*) for electrically coupling the second conductive body portion to a second limb of the user. An insulative portion 52 electrically insulates the first conductive body portion 48*a* from the second conductive body portion 48*b*, and a portable monitoring device 116 comprising a first lead electrically coupled to the first electrical interface 56*a* and a second lead electrically coupled to the second electrical interface 56*b*. The leads of the portable monitoring device 116 may be electrically coupled to the electrical interfaces 56*a* and 56*b* in any suitable manner. In one embodiment, the leads are electrically coupled in a detachable manner (e.g., using snaps) to allow the portable monitoring device 116 to be repaired or replaced. In another embodiment, the leads are electrically coupled in a more permanent fashion, such as through soldering.

Integrating a portable monitoring device 116 into the garment 40 allows the user to operate with improved mobility while continuously verifying that the user is properly grounded. In one embodiment, the portable monitoring device 116 comprises an alarm (e.g., an audio or visual alarm) that notifies when the garment 40 is not properly grounding the user. The portable monitoring device 116 may also comprise a battery for powering suitable monitoring circuitry, such as an ohmmeter, as well as suitable control circuitry. Similar to the embodiment of FIG. 8, the control circuitry may compensate for intermittent short periods of high resistance due to the user walking about the dissipative flooring.

In one embodiment, the user's work station includes a suitable dissipative flooring that dissipates static electricity from the user through the soles of the booties 62*a* and 62*b*. This embodiment may further improve the mobility of the user by eliminating the need to tether the user to ground. In one embodiment, the dissipative flooring has a suitable surface resistance higher than the resistance of the user so that the portable monitoring device 116 measures the resistance of the user rather than the resistance of the flooring between the booties 62*a* and 62*b*.

What is claimed is:

1. A method of monitoring a user wearing a static control garment, the method comprising providing a garment, the garment comprising a first conductive upper body portion including a first electrical interface, a second conductive upper body portion including a second electrical interface, a first user interface for electrically coupling the first conductive upper body portion to a first upper limb of the user, a second user interface for electrically coupling the second conductive upper body portion to a second upper limb of the user, and an insulative portion for electrically insulating the first conductive upper body portion from the second conductive upper body portion, wherein the insulative portion divides the garment in such a way that the amounts of material in the first and second conductive upper body portions do not differ by more than thirty percent, touching the first electrical interface to a first lead of a monitoring device; and touching the second electrical interface to a second lead of the monitoring device.

2. The method of monitoring as recited in claim 1, wherein the first user interface for electrically coupling the first conductive upper body portion to a first wrist of the user, and the second user interface for electrically coupling the second conductive upper body portion to a second wrist of the user.

3. The method of monitoring as recited in claim 1, further comprising measuring a resistance between the first electrical interface and the second electrical interface.

4. A method of monitoring a user wearing a static control garment, the method comprising providing a garment, the garment comprising a first conductive lower body portion including a first electrical interface, a second conductive lower body portion including a second electrical interface, a first user interface for electrically coupling the first conductive lower body portion to a first limb of the user, a second user interface for electrically coupling the second conductive lower body portion to a second limb of the user, and an insulative portion for electrically insulating the first lower body portion from the second lower body portion, wherein the insulative portion divides the garment in such a way that the amounts of material in the first and second conductive lower body portions do not differ by more than thirty percent, touching the first electrical interface to a first lead of a monitoring device; and touching the second electrical interface to a second lead of the monitoring device.

5. The method of monitoring as recited in claim 4, wherein the first user interface for electrically coupling the first conductive lower body portion to a first foot of the user, and the second user interface for electrically coupling the second conductive lower body portion to a second foot of the user.

6. The method of monitoring as recited in claim 4, wherein the first conductive lower body portion comprises a first bootie, and the second conductive lower body portion comprises a second bootie.

7. The method of monitoring as recited in claim 6, wherein a bottom of the first bootie comprises the first electrical interface, and a bottom of the second bootie comprises the second electrical interface.

8. The method of monitoring as recited in claim 7, further comprising the user placing the first bootie on the first lead of the monitoring device, and the user placing the second bootie on the second lead of the monitoring device.

9. The method of monitoring as recited in claim 6, wherein a length of the first and second leads of the monitoring device is at least one meter, further comprising the user walking the first bootie on the first lead of the monitoring device, and the user walking the second bootie on the second lead of the monitoring device.

10. The method of monitoring as recited in claim 4, further comprising measuring a resistance between the first electrical interface and the second electrical interface.

11. A static control garment configured to be worn by a user, the garment comprising:

a first conductive body portion including a first electrical interface;

a second conductive body portion including a second electrical interface;

a first user interface for electrically coupling the first conductive body portion to a first limb of the user;

a second user interface for electrically coupling the second conductive body portion to a second limb of the user;

an insulative portion for electrically insulating the first conductive body portion from the second conductive body portion; and a portable monitoring device electrically coupled to the first and second electrical interfaces, wherein the amounts of material in the first and second conductive body portions do not differ by more than thirty percent; and further wherein the first conductive body portion comprises a first bootie operable to dissipate static electricity from the user to dissipative flooring and;

the second conductive body portion comprises a second bootie operable to dissipate static electricity from the user to the dissipative flooring.

12. The static control garment as recited in claim 11, wherein the first limb of the user comprises a first upper limb of the user, and the second limb of the user comprises a second upper limb of the user.

13. The static control garment as recited in claim 12, wherein the first upper limb of the user comprises a first wrist of the user, and the second upper limb of the user comprises a second wrist of the user.

14. The static control garment as recited in claim 11, wherein the first limb of the user comprises a first lower limb of the user, and the second limb of the user comprises a second lower limb of the user.

15. The static control garment as recited in claim 14, wherein the first lower limb of the user comprises a first foot of the user, and the second lower limb of the user comprises a second foot of the user.

* * * * *